United States Patent [19]

Lambert et al.

[11] Patent Number: 4,850,915

[45] Date of Patent: Jul. 25, 1989

[54] APPARATUS FOR DEPLOYING AND SUPPORTING A LARGE APERTURE VOLUMETRIC ARRAY IN A MEDIUM

[75] Inventors: Eric M. Lambert, E. Bridgewater, Mass.; William C. Beck, Milford, Conn.; James R. Wilson, Santa Barbara, Calif.

[73] Assignee: Hazeltine Corporation, Greenlawn, N.Y.

[21] Appl. No.: 37,267

[22] Filed: Apr. 10, 1987

[51] Int. Cl.[4] ..... B63B 21/52

[52] U.S. Cl. ..... 441/21; 441/33

[58] Field of Search ..... 441/1, 7, 23, 24, 26, 441/32, 33; 405/171, 195; 367/3-6

[56] References Cited

U.S. PATENT DOCUMENTS

| | | | |
|---|---|---|---|
| 3,986,159 | 10/1976 | Horn | 441/33 |
| 4,208,738 | 6/1980 | Camborn | 441/33 |
| 4,388,023 | 6/1983 | Cochrane | 405/171 |
| 4,494,938 | 1/1985 | Flood et al. | 441/33 |
| 4,590,590 | 5/1986 | Toone et al. | 441/33 |
| 4,725,988 | 2/1988 | Secretan | 441/33 |

FOREIGN PATENT DOCUMENTS

| | | | |
|---|---|---|---|
| 197809 | 9/1978 | United Kingdom | 441/33 |

*Primary Examiner*—Sherman D. Basinger
*Assistant Examiner*—Stephen P. Avila
*Attorney, Agent, or Firm*—E. A. Onders

[57] ABSTRACT

An apparatus for supporting a large volumetric array of acoustic sensors in water is packaged in a standard configuration sonobuoy envelope and utilizes conventional sonobuoy deployment components. A housing within the envelope contains a plurality of tubular extendable members stored on drums and extendable to form array support booms upon deployment of the apparatus. A plurality of releasable array modules are releasably attached to the housing, each module containing an array cable and a plurality of acoustic sensors secured to and along the cable. As the apparatus enters and descends through the water, the tubular members extend to form array support booms. The array modules are synchronously released to the extension of the tubular members and as the modules descend, the array cables and acoustic sensors deploy, the array cables forming catenaries between points on array support boom pairs or between the housing and points on the various booms. A non-rigid, four-boom hanging catenary array structure is thereby deployed.

12 Claims, 4 Drawing Sheets

APPARATUS FOR DEPLOYING AND SUPPORTING A LARGE APERTURE VOLUMETRIC ARRAY IN A MEDIUM

The Government has rights in this invention pursuant to Contract No. N6601-83-C-0301 awarded by The Department of the Navy.

BACKGROUND OF THE INVENTION

1. Field of the Invention

The invention relates generally to an apparatus for deploying and supporting an interconnected set of elements in a medium and, in particular, to an apparatus for deploying and supporting a large aperture volumetric array of acoustic sensors in water.

2. Description of the Prior Art

Sonobuoys configured for deploying vertical line arrays of acoustic sensors are well known in the art. More recently, horizontal line arrays of acoustic sensors have been developed, as for example disclosed in U.S. Pat. No. 4,388,023 for a TRUSS ARRAY FOR SUPPORTING DEVICES WITHIN A FLUID MEDIUM.

The continued reduction of the acoustic signal level sought to be detected by sonobuoys—particularly the reduction of narrow band spectral lines—and the increase of low frequency ambient noise have reduced the effectiveness of currently available sensors. Large aperture volumetric arrays having high gain against broad band acoustic signatures provide increased effectiveness in detection.

A large aperture volumetric array is generally comprised of a structure supporting a large number of loosely constrained acoustic sensors disposed in a three dimensional array. The size, complexity and working environment of this type of large, non-rigid, quasirandom array, however, present significant mechanical deployment and structural support design problems. A feasible mechanical deployment and structural support apparatus that does not significantly degrade the acoustic performance of the large aperture volumetric array is needed but has not heretofore been available.

SUMMARY OF THE INVENTION

It is an object of this invention to provide an apparatus for deploying and supporting a large volumetric array of elements in a medium.

It is another object of this invention to provide an apparatus for deploying and supporting a large volumetric array of acoustic sensors in a medium.

It is another object of this invention to provide a mechanically elegant apparatus for deploying and supporting a large volumetric array of elements in a medium.

It is another object of this invention to provide an apparatus, for deploying and supporting a large volumetric array of acoustic sensors in a medium, which does not significantly degrade the performance of the array.

It is another object of this invention to provide an apparatus packaged in a relatively standard configuration sonobuoy envelope for deploying and supporting a large volumetric array of acoustic sensors in a medium.

It is another object of this invention to provide an apparatus for deploying and supporting a large aperture volumetric array of elements in a fluid medium, the deployed array support structure being not entirely rigid.

In accordance with the present invention, the apparatus is generally packaged in a standard configuration sonobuoy envelope with standard and conventional sonobuoy deployment components. A housing located within the envelope contains a plurality of storable tubular extendable members stored flat on drums and a drive means for extending the storable tubular extendable members. A plurality of guy lines are also stored in the envelope and housing. Secured to the lower portion of the housing are a plurality of releasable array modules, each containing an array cable having a plurality of acoustic sensors attached along its length.

The envelope is dropped from the air into water and, as the envelope descends in the water, the storable tubular members automatically extend to form array support booms. Simultaneously, and synchronized with the extension of the storable tubular members, the guy lines deploy and the array modules are released. The array cables and acoustic sensors deploy from the modules and the deployed array cables form catenaries strung between points on the array support booms and between the housing and various points on the array support booms.

For a better understanding of the present invention, together with other objects, features and advantages thereof, reference is made to the following description taken in conjunction with the accompanying drawings, the scope of the invention to be pointed out in the appended claims.

BRIEF DESCRIPTION OF THE DRAWINGS

In the drawings, wherein similar reference numerals denote similar elements throughout the several views.

DESCRIPTION OF THE PREFERRED EMBODIMENT

Figure 1:
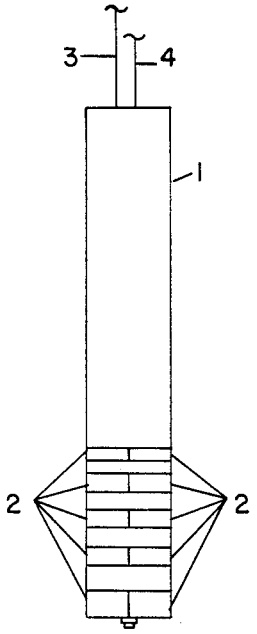
FIG. 1 is a side elevation schematic illustration of an apparatus according to the invention.

The present invention is directed to an apparatus for deploying and supporting elements in a fluid medium. More particularly, the invention is directed to an apparatus for deploying and supporting a large aperture volumetric array of sensors in water. In the contemplated and currently preferred embodiment described herein, and as depicted in the accompanying drawings, an array support structure is deployed to support a four-boom hanging catenary array of 256 spatially isolated omni-directional acoustic sensors. The boom structure of the array is located at an approximate depth of 1,300 feet and the deployed array of acoustic sensors has a vertical aperture of 280 feet and a horizontal aperture of 130 feet. The complex packaging and deployment of such a large, three-dimensional array is achieved in accordance with the invention through a modular and methodological storage and deployment scheme.

To achieve compatibility with the P-3 and the S-3ASW aircraft in both the bomb bay and wing launch configurations, the preferred embodiment of the apparatus is packaged in an envelope having the same general dimensional and weight specifications as the MK-46 and the Advanced Lightweight Torpedo, which are 12.75 inches in diameter, 117 inches in length and 800 pounds maximum weight. The envelope containing the apparatus is divided into three stacked sections. The top section contains conventional sonobuoy deployment components including a parachute, inflation apparatus, deployment float, surface float, antenna, RF transmitter electronics, battery pack, suspension cable, uplink cable, compliant line and drogue. For ease of illustration, only those components of the deployed apparatus pertinent to the present invention are illustrated in the drawings. The suspension system is formed of the surface float 8, suspension cable 17, an uplink cable, compliant line and a drogue. All of these components are packaged using well-known and conventional sonobuoy stack-up of component methodology. A vertical guy line storage and deployment unit 16 is also packaged in this section of the envelope. The apparatus utilizes, for each array support boom, two vertical guy lines 7 descending from an apex at the deployment unit 16 for support and stabilization both during and at full deployment. One vertical guy line extends to the distal end of an array support boom 5 and the other line to a point along the array support boom 5.

With reference now to FIG. 1, the central section of the envelope contains a housing 1 for a system of standard components for erecting the array support booms 5. That system is comprised of a drive unit and four boom deployment units. The drive unit, which derives its power from the descent of the housing in the water and is sometimes referred to as a gravity motor, includes a spool (not shown) mounted on a shaft disposed substantially perpendicular to the length of the housing and envelope. The free end of a cable 3 wound about the spool is secured to the suspension system. It is important to note that the signal cable 4 between the housing 1 and the guy line deployment unit 16 is separate from the support cable 3 wound about the drive unit spool because the operative rotation and environment of the spool normally precludes maintenance of a reliable electrical connection.

Soon after the apparatus enters the water, the suspension system deploys and the surface float inflates and rises to the surface. As housing 1 descends, the cable 3 wound about the drive unit spool is drawn off the spool causing the spool to rotate and thus supplying the drive unit with rotational power. Since a sufficient power reserve is required to overcome any large dynamic loads, that power in excess of normal demand must be dissipated. This power dissipation is accomplished by operation of a pair of hydraulic pump pistons which provide a damping force proportional to the descent velocity of housing 1. One end of each piston is fixed to the housing, the other end being rotatably attached to a crankshaft crank disposed parallel to the drive unit shaft and being associated with the drive unit shaft by means of a belt and pulleys. Another pulley mounted on the drive unit shaft provides a power take-off for the deployment units.

Figure 6:
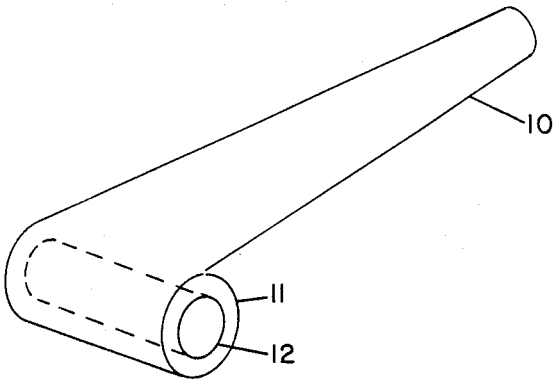
FIGS. 6 and 7 are perspective schematic illustrations of a storable tubular extendable member, its storage on a drum and its initial extension from the drum.
Figure 7:
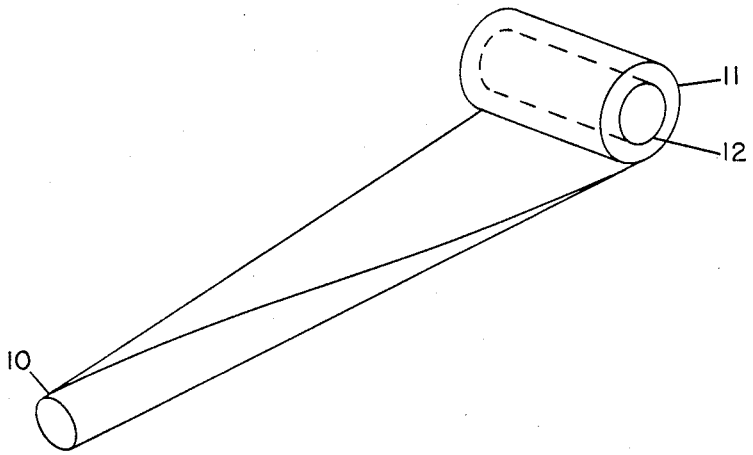
Figure 8:
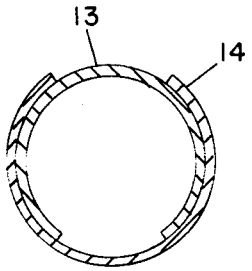
FIG. 8 is a cross-sectional view of an extended storable tubular extendable member within a second extended storable tubular extendable member for use in an apparatus according to the invention.

Stacked below the drive unit in housing 1 are four boom deployment units. Each such unit is comprised of a drum mounted on a shaft disposed substantially perpendicular to the length of the housing and envelope. Stored flat on the drums are storable tubular extendable members (STEMs). STEMs, the principle of which is illustrated in FIGS. 6 and 7, are well known in the prior art (see for example U.S. Pat. Nos. 3,434,674 and 3,371,453). FIGS. 6 and 7 are schematic illustrations from two perspectives of a STEM 10 having a portion 11 rolled flat for storage on drum 12. Rotation of drum 12 causes extension of STEM 10 out from the drum permitting it to revert to the tubular form in which it was fabricated. In the currently preferred embodiment of the apparatus, each STEM consists of two stainless steel strips, of approximately 0.010 inch thickness, fabricated as curled sheets. The curled sheets, in what is commonly referred to as a bi-STEM construction, are rolled together flat on a drum. As the drums are operatively rotated, the bi-STEM strips are extended and furl, one inside the other, to form a telescoping tube and thereby extend to form array support booms. FIG. 8 illustrates a typical circular cross-section of an extended bi-STEM construction showings strips 13 and 14 furled, one inside the other.

As indicated, four STEM deployment units are stacked below the drive unit in the housing 1. The deployment units are oriented for deploying four horizontal 80-foot support booms 5 (FIGS. 2, 3 and 5) at 90 degree angular intervals about the housing. Each deployment unit has two pulleys mounted on its shaft, one on each side of the drum. The topmost deployment unit receives rotational power from the drive unit for extending the STEM stored on its drum by way of a belt between one of its drum shaft pulleys and a pulley on the drive unit shaft. The other pulley on the deployment unit shaft supplies rotational power for the deployment unit stacked immediately therebelow via a connecting belt. The remaining deployment units receive their rotational power in a similar manner.

In-plane guy lines 9 (FIG. 5) are also stored, in cassettes, in the STEM housing. The in-plane lines 9 serve to prevent the deployed array support booms 5 from deforming beyond their structural ability. Two in-plane guy lines 9 are attached between adjacent array support booms, one being connected between the distal ends of adjacent booms, and the other between the midpoints along adjacent booms.

The array structure deployed by the particular form of the inventive apparatus herein disclosed is a four boom hanging catenary array. 256 acoustic sensors are located along 18 array cables 6, each array cable strung as a catenary between points on pairs of array support booms 5 or between housing 1 and a point on one of the array support booms. Array cables 6 and the attached acoustic sensors are stored in 18 releasable array modules 2 located in the lower section of the envelope below housing 1 which contains the STEM drive and deployment units. The semi-circularly shaped array modules 2 are stored in nine levels of an array storage tree, two array modules 2 per level. The array modules 2 are released, two at a time, in synchronization with the extension of the STEMs. The packaging of the array cables 6 and acoustic sensors in the array modules 2, and of the array module storage tree and release mechanisms, are based on and in accordance with well known and conventional sonobuoy practice, particularly horizontal line array packaging technology.

The array cables 6 are generally comprised of two conductive wires and a strengthening member, typically of DuPont Kevlar, woven together into a flexible cable. The cable is weighted to provide a uniform weight of 0.01 pounds per foot in water to minimize tilting of the strung catenaries due to the relative flow of water past the array. To achieve the desired weight distribution, additional weights are usually added to the acoustic sensors. The acoustic sensors are omni-directional hydrophones of conventional design. Such hydrophones are generally comprised of two flexural disc bender elements encapsulated by a urethane coating.

The preferred embodiment of the apparatus is usually launched from an aircraft, a parachute slowing the descent of the apparatus to an acceptable water entry velocity and additionally serving to substantially vertically orient the apparatus for smooth water entry and proper deployment. Upon water entry, a sea water actuated switch causes inflation of the small deployment float, which causes the parachute to be released whereupon the deployment float draws out the uninflated surface float which subsequently inflates and rises to the surface. The suspension system is then deployed and serves to support the apparatus at a particular depth, provide a signal uplink between the antenna on the surface float and the sensor electronics, and act as a mechanical filter for the attenuation of surface waves.

Following deployment of the suspension system, the vertical guy line storage and deployment unit 16 is deployed at a depth of approximately 1,000 feet. Since housing 1, containing the STEMs to which the vertical guy lines 7 are attached, continues to descend, lines 7 thus begin to deploy at this point. An important feature of vertical guy line deployment unit 16 is that the STEMs 5 are supported by guy lines 7 from initial to completed deployment of the STEMs. The tension supplied by vertical guy lines 7 is variable and depends upon the extended length of the STEMs 5. The continued descent of the housing 1 and the array storage tree at a rate of approximately 0.625 feet per second draws support cable 3 from the drive unit spool, rotating the spool and thus providing rotational power for operating the STEM deployment units.

The deployment of vertical guy lines 7 and inplane guy lines 9 and the release of array modules 2 are synchronized with the extension of STEMs 5. This concurrent and synchronous deployment is essential to preventing entanglement of the guy lines and array cables as housing 1 rotates during its descent. The radial outward extension of the 80-foot STEMs 5 from their storage condition takes place at a rate of approximately two inches per second, providing a total deployment time of approximately 480 seconds. With STEMs 5 completely extended, guy lines 7 in place and array cables 6 deployed, housing 1 of the disclosed embodiment is located at a depth of approximately 1,300 feet.

The vertical and in-plane guy lines 7 and 9 are secured to the STEMs by means of slip rings which encircle the telescoping tube and which are positionaly maintained by lines extending from the distal ends of the booms 5 to the housing. The use of slip rings for guy line securement to the array support booms advantageously minimizes deployment complexity. Guy line support of STEMs 5 is necessary both during and after deployment to prevent failure of the STEMs which may be caused by the action of hear currents.

As noted above, the release of the array modules 2 is synchronized to the extension of the STEMs 5. Synchronization may for example be accomplished, as is well known, by a control system which includes a Hall sensor for counting the revolutions of a STEM storage drum, the control system electrically activating a firing mechanism to release the array modules 2 at specific points in the count. The modules 2 are released sequentially, two at a time, from the bottom of the storage tree up. The array modules are typically weighted in the nose to provide a rapid vertical descent at a rate of approximately 1.2 feet per second which is greater than the descent rate of the housing (0.625 feet/second). This more rapid descent prevents entanglement of the outwardly extending array support booms 5 with array cables 6. The array cable 6 and attached hydrophones for each half of each catenary are deployed simultaneously from opposite sides of the respective array module 2.

Figure 2:
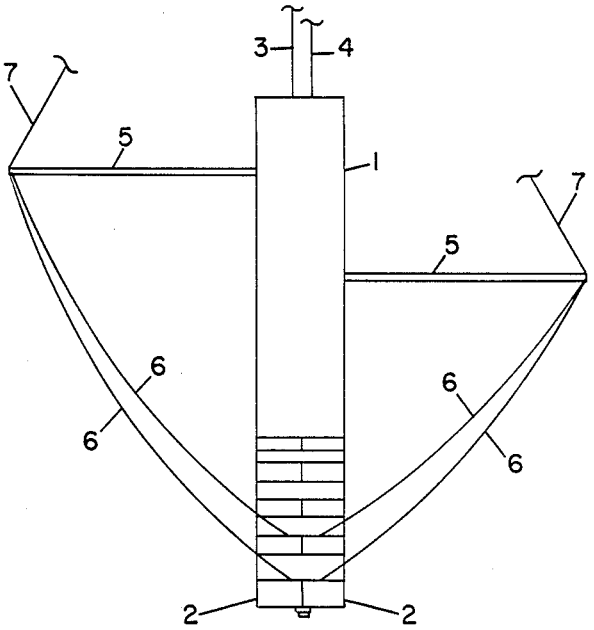
FIG. 2 is a side elevation schematic illustration of an apparatus according to the invention showing the initial deployment of the storable tubular extendable members and the array cables.
Figure 3:
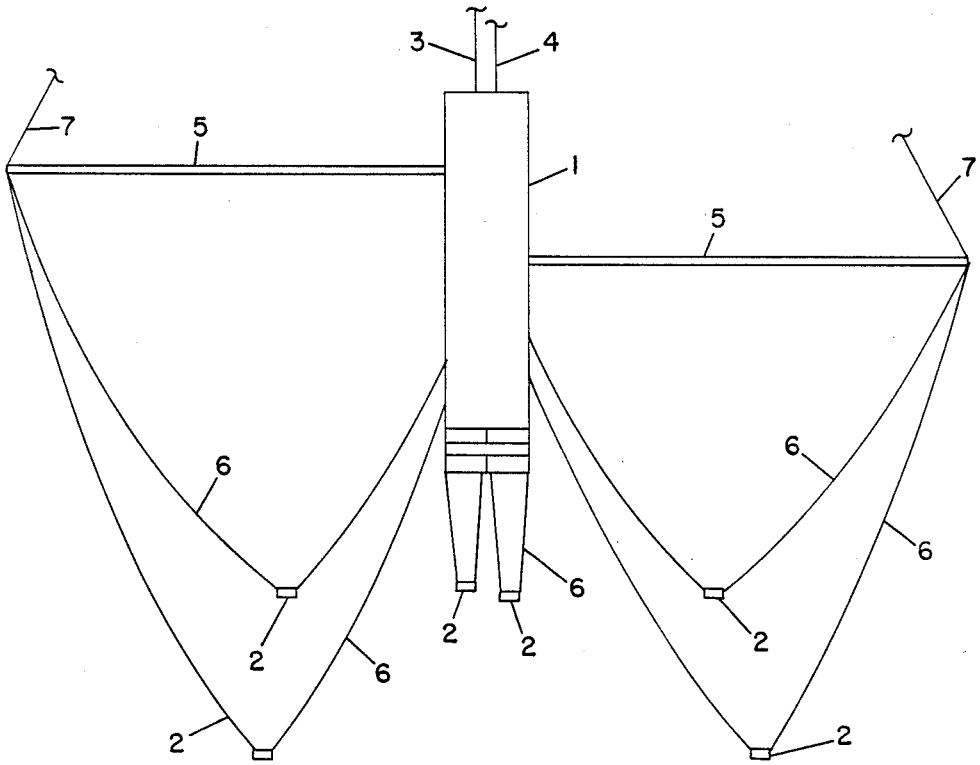
FIG. 3 is a side elevation schematic illustration of an apparatus according to the invention showing further deployment of the storable tubular extendable members and array cables and the array modules descending in the medium.
Figure 4:
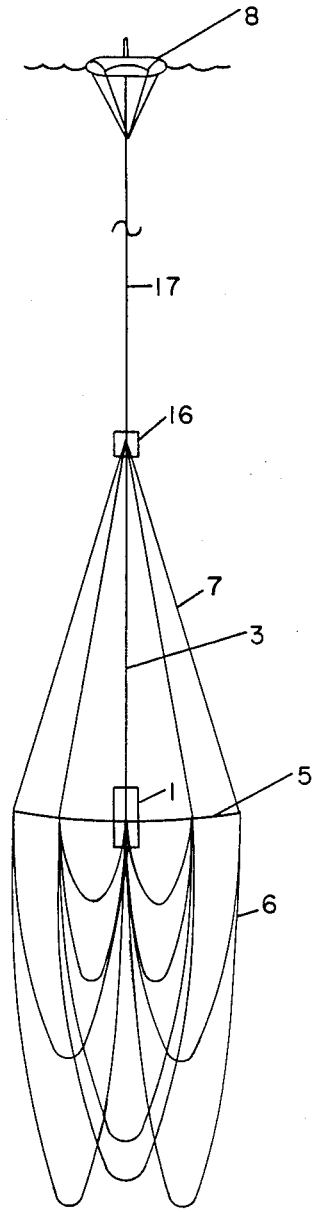
FIG. 4 is a side elevation schematic illustration showing the apparatus of the invention at full deployment and the relationship of the apparatus to the out-of-scale surface float.

FIGS. 1 through 4 depict the apparatus of the invention at various stages of its deployment. In FIG. 1, the vertical guy line deployment unit 16 has just been deployed, housing 1 continues its descent and cable 3 is drawn from its spool. FIG. 2 illustrates the initial extension of the STEMs 5 and the deployment of array cables 6 from the array modules. Note that the drawings of FIGS. 1 through 3 do not, for ease of depiction, include the guy lines. In FIG. 3, the STEMs 5 have been further extended, and the array modules have been released and the array cables 6 have begun their deployment from the modules. FIG. 4 shows the apparatus fully deployed.

Figure 5:
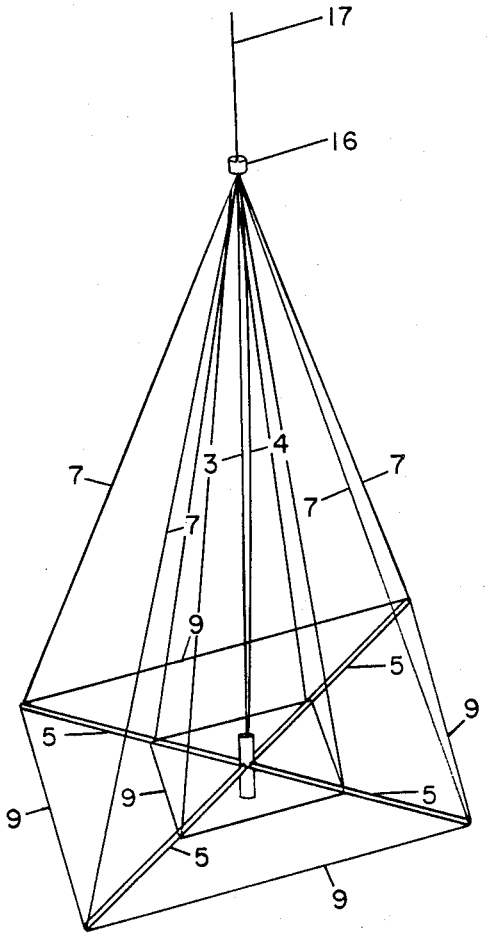
FIG. 5 is a perspective schematic illustration of an apparatus according to the invention showing the extended support booms and the guy lines but omitting the deployed array catenaries.

At full deployment, as depicted in FIG. 4, the array support structure comprises central housing 1 suspended by a cable 3 extending upward to vertical guy line deployment unit 16 and the suspension system, which includes the surface float 8 and suspension cable 17. Housing 1 is normally operatively maintained at a depth of approximately 1,300 feet. As seen in FIG. 5, the four array support booms 5 extend radially outward and substantially horizontally from the central housing at approximately 90 degree intervals. Each array support boom 5 has two vertical guy lines 7 attached at a mid-point and at the radially outward end of the boom, respectively, and both extending upward to an apex at the vertical guy line deployment unit 16 which is disposed at a depth of approximately 1,000 feet. Adjacent array support booms 5 are connected by pairs of inplane guy lines 9. Eighteen array cable catenaries 6 are strung either between pairs of array support booms 5 and between housing 1 and respective array support booms 5. The omni-directional hydrophones are distributed in a random fashion along the eighteen array cable catenaries. In placing the hydrophones, a minimum average spacing of one wavelength at the frequency sought to be detected should be maintained; linear and planar hydrophone placement and geometric symmetries in the placement of the hydrophones should be avoided. For appropriate processing of the signals detected by the hydrophones, the hydrophone locations must be determinable, and this may be accomplished by a known system which utilizes a reference signal projector located on the distal end of each array support boom 5.

The acoustic performance of a large aperture volumetric array is based on the principles of random array theory but, since the locations of the hydrophones are fixed by mechanical structure, the array is actually not truly random. Randomness is, however, introduced because the array structure is not entirely rigid. In particular, the hydrophone supporting array cable catenaries are freely-deformable by the water currents.

While there have thus been shown and described and pointed out fundamental novel features of the invention as applied to a preferred embodiment thereof, it will be understood that various omissions and substitutions and changes in the form and details of the apparatus illustrated and in its operation may be made by those skilled in the art without departing from the spirit of the invention. For example, it is contemplated that a large volumetric array in accordance with the invention may be implemented incorporating only three array support booms or, alternatively, more than four array support booms. In addition, because the length of the array support booms is dependent upon the size of the array to be implemented, the booms may be dimensioned other than as herein described. More or fewer guy lines may also be utilized and, as should be evident to those skilled in the art, the number and precise arrangement of array cables and acoustic sensors may vary from that described in the embodiment herein disclosed.

It should also be understood that many of the individual elements or components of the large aperture volumetric array of the invention, such as the suspension system, STEM deployment apparatus, guy line deployment apparatus, array modules, array cables and acoustic sensors are conventional and may therefore be implemented in any desired manner. The details of such individual components have not, accordingly, been described or illustrated in detail and should be understood as being part of the inventive subject matter herein only by their use and disposition in relation to the various other portions of the apparatus.

Many additional modifications are possible and are contemplated in the implementation of an apparatus in accordance with the present invention. It is the intention, therefore, to be limited only as indicated by the scope of the claims appended hereto.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. An apparatus for deploying and supporting an array of elements in a fluid medium, said apparatus comprising:

a housing;

suspension means for suspending said housing at a particular elevation in the medium;

a plurality of tubular members capable of being stored flat in rolled form in said housing, each said tubular member being extendable to form an array support boom;

support means for supporting and stabilizing the tubular member when said members are extended;

a plurality of array cables each having a portion connected between two points on the combination of said tubular members and said housing; and means for deploying said array cables from storage in said housing;

said cables being deployable in a spaced relationship suitable for positioning an array of elements.

2. The apparatus of claim 1, wherein said array cables are connected between points on pairs of said tubular members and between said housing and a point on one of said tubular members, so that said portions of the array cables form catenaries upon deployment of said apparatus.

3. The apparatus of claim 1, wherein the portions of said array cables between the respective connection points are substantially longer than the distance between such points and are suspended in catenary configuration.

4. The apparatus of claim 1, wherein said tubular members are attached at one end to the housing and extend out substantially perpendicularly in different directions.

5. In apparatus for deploying and supporting a large array of acoustic sensors in water, the combination comprising:

a housing descendable in and through water;

suspension means for suspending said housing at a particular depth in water;

a plurality of tubular members capable of being stored flat in rolled form in said housing, each said tubular member being extendable to for an array support boom;

at least one first guy line extending from each tubular member to said suspension means so as to support and stabilize each said tubular member during extension and at full extension of said member;

at least one second guy line extending between adjacently disposed ones of said tubular members for supporting and stabilizing said tubular member during extension and at full extension of said member; and a plurality of releasable modules attached to said housing for operative deployment therefrom, said modules being predeterminately weighted to descend after release more rapidly that said housing, and each said module containing an array cable, said array cables being connected between points on pairs of said tubular members and between said housing and a point on one of said tubular members;

said releasable modules being arranged for release from said housing in synchronization relative to the extension of said tubular members so that said array cables are released from within said modules for relatively free suspension from said housing and tubular member in a spaced relationship suitable for positioning an array of acoustic sensors.

6. In apparatus for deploying and supporting an array of acoustic sensors in water, the combination comprising:

a housing for initially containing all elements of the combination;

suspension means for suspending said housing at a particular depth in water;

a plurality of tubular members capable of being stored flat in rolled form in said housing, each said tubular member being extendable to form an array support boom extending from the housing;

support means for supporting and stabilizing the tubular members when said members are extended;

a plurality of array cables each having a portion connected between two points on the combined structure of said tubular members and said housing; and means for deploying said array cables from storage in said housing and permitting the portions of the cables between said points to be suspended in spaced relationship suitable for positioning an array of elements.

7. The apparatus of claim 6, wherein said support means comprises at least one guy line extending from each said tubular member to said suspension means.

8. The apparatus of claim 6, wherein said support means comprises at least one guy line extending between adjacently disposed ones of said tubular extendable members.

9. The apparatus of claim 6, wherein said support means comprises at least one guy line extending from each tubular member to said suspension means and at least one guy line extending between adjacently disposed ones of said tubular extendable members.

10. The apparatus of claim 6, wherein said apparatus when deployed comprises a large aperture volumetric array.

11. The apparatus of claim 6, wherein said elements are movable relative to each other when said apparatus is deployed to form a relatively non-rigid array.

12. The apparatus of claim 6, wherein the portions of said array cables between the respective connection points are substantially longer than the distance between such points and are suspended in catenary configuration.

* * * * *